United States Patent [19]

Takahashi et al.

[11] Patent Number: 4,688,523

[45] Date of Patent: Aug. 25, 1987

[54] METHOD AND APPARATUS FOR COOLING CYLINDER HEAD OF AN ENGINE

[75] Inventors: Ken Takahashi; Munenori Kiryu, both of Shizuoka, Japan

[73] Assignee: Suzuki Motor Co., Ltd., Japan

[21] Appl. No.: 775,265

[22] Filed: Sep. 12, 1985

[30] Foreign Application Priority Data

| | | | |
|---|---|---|---|
| Sep. 14, 1984 | [JP] | Japan | 59-193090 |
| Sep. 14, 1984 | [JP] | Japan | 59-193091 |
| Sep. 14, 1984 | [JP] | Japan | 59-193095 |
| Sep. 14, 1984 | [JP] | Japan | 59-140053 |

[51] Int. Cl.[4] ..... F01P 3/16; F01M 5/00

[52] U.S. Cl. ..... 123/41.32; 123/41.42; 123/90.37; 123/90; 123/38; 123/41.82 R; 123/196 AB

[58] Field of Search ..... 123/41.42, 41.82 R, 123/41.82 A, 41.32, 193 H, 196 M, 196 AB, 90.38, 90.37, 90.27, 188 GC

[56] References Cited

U.S. PATENT DOCUMENTS

| | | | |
|---|---|---|---|
| 2,085,810 | 7/1937 | Ljungstrom | 123/41.42 |
| 3,377,946 | 4/1968 | Kotlin et al. | 123/41.82 R |

*Primary Examiner*—William A. Cuchlinski, Jr.
*Attorney, Agent, or Firm*—Diller, Ramik & Wight

[57] ABSTRACT

Method and apparatus for cooling the cylinder head of an engine of the type in which oil is delivered to the area located above the combustion chambers in the cylinder head and the latter is cooled by thus delivered oil. Oil introducing means through which oil is introduced into the area located above the combustion chambers in the cylinder head are disposed in the vicinity of ignition plug fitting bosses on the cylinder head whereby oil pumped up from the oil supplying device is delivered to the area located above the combustion chambers in the cylinder head through the oil introducing means.

15 Claims, 19 Drawing Figures

METHOD AND APPARATUS FOR COOLING CYLINDER HEAD OF AN ENGINE

BACKGROUND OF THE INVENTION

1. Field of the Invention

The present invention relates to a method of an apparatus for cooling the cylinder head of an engine, particularly, an air cooling type internal combustion engine.

2. Description of the Prior Art

As is well known, various types of cooling methods are employed for engine, particularly, internal combustion engine in order to protect it from adversely affected state due to heat generated in combustion chambers and maintain it under the properly determined temperature condition.

The conventional cooling methods are generally classified into cooling method with the use of air flowing and cooling method with the use of water flowing.

Specifically, the air cooling method is intended to cool engine by utilizing flow of air which passes by the surface of fins standing upright from both the cylinder block and cylinder heads of the engine.

On the other hands, the water cooling method is intended to cool engine by utilizing flowing of water through water jackets which are formed in both the cylinder block and the cylinder head.

When the air cooling method is employed for the purpose of cooling engine, there is only a necessity for forming a number of heat radiating fins on both the cylinder block and the cylinder head of the engine and this leads to an advantageous feature that the whole engine can be designed and constructed in a very simple structure. However, it has drawbacks that it is difficult to uniformly cool down the whole engine, temperature control is achieved only with much difficulties and both the cylinder block and the cylinder head are liable to be deformed thermally.

On the other hands, when the water cooling method is employed for the same purpose, every part of engine can be cooled more uniformly than the air cooling method. However, it has drawbacks that the engine is constituted by a large number of parts and components because of a necessity for arranging radiator, fan and others and moreover it is produced by way of many complicated steps (inclusive a step for producing a core) because of a necessity for forming water jackets in both the cylinder block and the water head, resulting in increased production cost.

SUMMARY OF THE INVENTION

Hence, the present invention has been made with the foregoing background in mind and its object resides in providing a method of cooling the cylinder head of an engine of the type in which the area located in the proximity of the combustion chambers in the cylinder head is uniformly cooled by employing a simple structure.

Other object of the present invention is to provide an apparatus for cooling the cylinder head of an engine of the type which assures that cooling is effected without any necessity for water jackets which are produced by way of many steps and moreover the cylinder head is produced at a reduced cost.

Another object of the present invention is to provide an apparatus for cooling the cylinder head of an engine of the type which assures that the engine is constituted by a reduced number of components in the light and compact structure by using lubricating oil as cooling medium.

To accomplish the above object there is proposed according one aspect of the invention a method of cooling 20 cylinders of an engine which is characterized in that the method includes a step of feeding oil to the area located above the combustion chambers in the cylinder head.

Further, there is proposed according to another aspect of the invention which is characterized in that oil introducing means for introducing oil to the area located above the combustion chamber in the cylinder head is arranged at the position located in the vicinity of each of ignition plug fitting bosses in the cylinder head.

Other objects, features and advantages will become readily apparent from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENTS

Now, the present invention will be described in a greater detail hereunder with reference to the accompanying drawings which illustrate method and apparatus according to preferred embodiments thereof.

Figure 1:
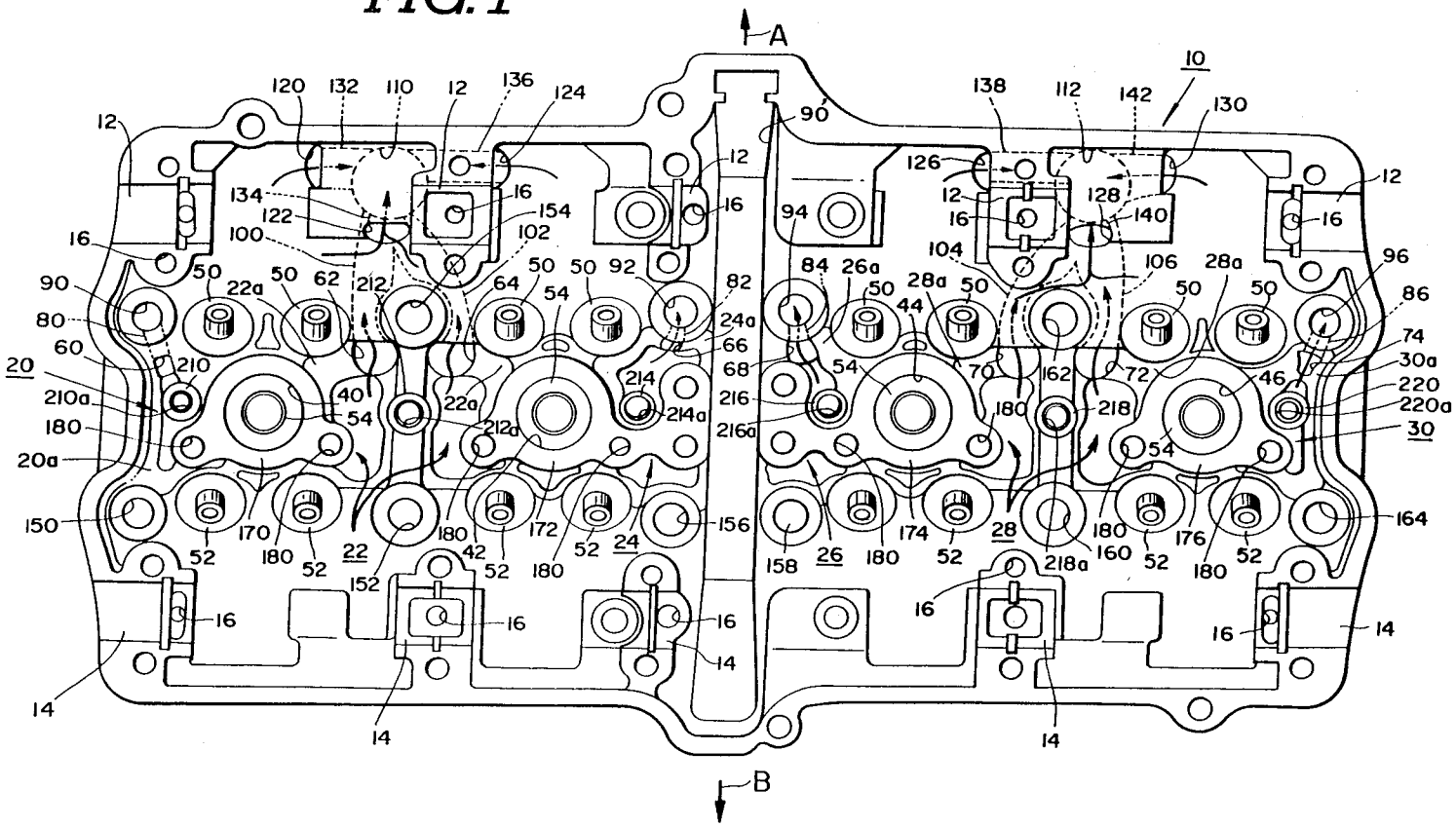
FIG. 1 is a plan view of the cylinder head to which the present invention is applied, as seen from the above.
Figure 2:
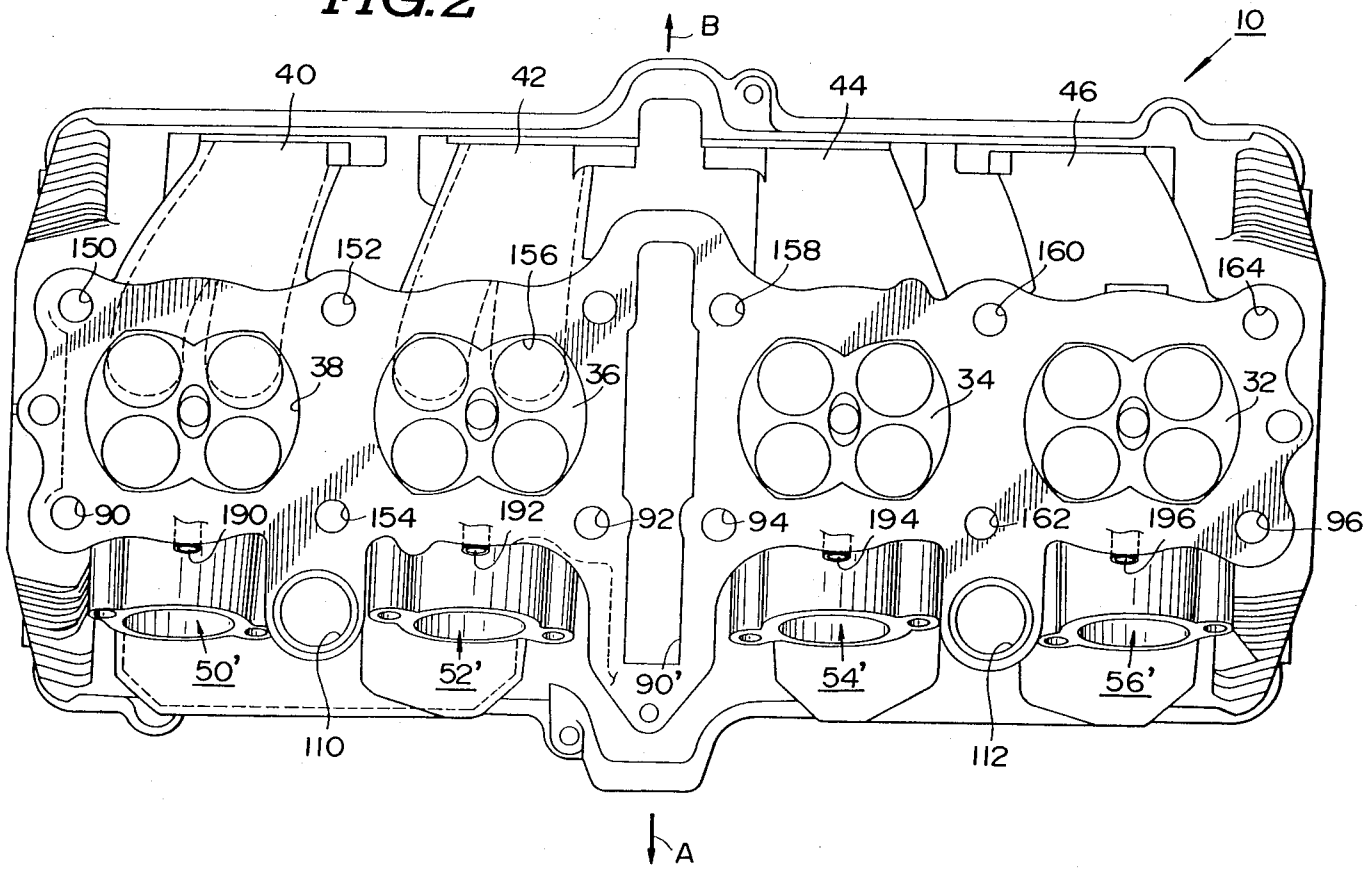
FIG. 2 is a plan view of the cylinder head in FIG. 1, as seen from the below.

FIG. 1 and 2 are a plan view of a cylinder head 10 as seen from the above and the below respectively, in which oil passages according to the present invention are employed for the cylinder head 10, particularly for cylinder head used for a double overhead camshaft type engine preferably mounted on motorcycle.

As shown in FIG. 1, the cylinder head 10 is provided with bearing portions 12 and 14 for cam shafts (not shown) adapted to drive rocker arms. Specifically, the bearing portions 12 are located on the exhaust side (as identified by an arrow mark A), while the bearing portions 14 are located on the inlet port side (as identified by an arrow mark B). Further, the cylinder head 10 is provided with another bearing portions for rocker shafts (not shown) adapted to turnably support rocker arms on both the exhaust and inlet sides at the position located below the bearing portions 12 and 14.

As is apparent from FIG. 1, a plurality of lubricating oil spouting holes 16 through which pressurized lubricating oil (hereinafter referred to simply as oil) is pumped up via oil galleries (not shown) formed in the cylinder head 10 are disposed at the position located in the vicinity of the bearing portions 12 and 14.

Figure 3:
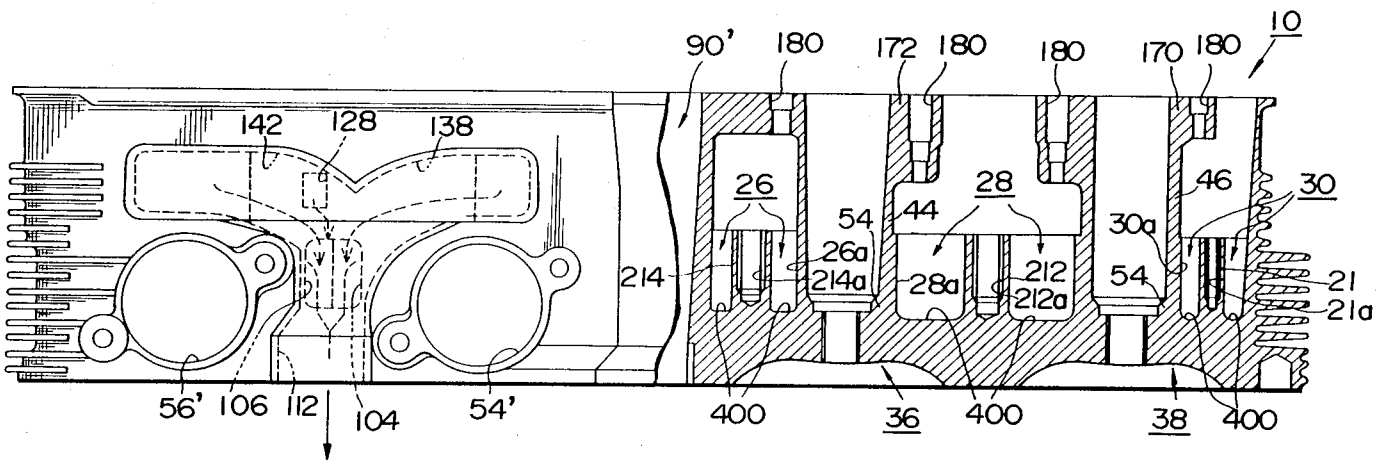
FIG. 3 is a partially sectioned front view of the cylinder head in FIG. 1.

Referring to FIG. 1 again, a plurality of recesses 20, 22, 24, 26, 28 and 30 are formed in the area extending in the longitudinal direction on the middle part of the inner surface of the cylinder head 10. Specifically, the recesses 20, 22, 24, 26, 28 and 30 are disposed at the position located approximately above combustion chambers 32, 34, 36 and 38 as illustrated in FIG. 2. Further, referring to FIG. 3 which is a partially sectioned front view of the cylinder head 10, the recesses 20, 22, 24, 26, 28 and 30 are formed in the area including the space as defined by the bore diameter of the combustion chambers 32, 34, 36 and 38 (but excluding the area occupied by cylindrical bosses 40, 42, 44 and 46 for mounting ignition plugs, the cylindrical bosses 40, 42, 44 and 46 being located above the central part of the combustion chambers 32, 34, 36 and 38). Thus, as shown in FIG. 1, the peripheral walls 20*a*, 22*a*, 24*a*, 26*a*, 28*a* and 30*a* of the recesses 20, 22, 24, 26, 28 and 30 are located adjacent to the peripheral walls of valve seats 50 for supporting exhaust valves and valve seats 52 for supporting inlet valves and moreover, as shown in FIG. 3, they are located adjacent to the peripheral walls of the ignition plug seats 54 provided for the combustion chambers 32, 34, 36 and 38. As oil is supplied into the recesses 20, 22, 24, 26, 28 and 30 formed in the above-described manner by an injection from oil feeding passages which will be described later, it is increasingly accumulated in each of the recesses 20, 22, 24, 26, 28 and 30 and a thermal boundary layer between each of the recesses and thus accumulated oil is then disturbed or broken by injection of oil whereby heat transmitted from the combustion chambers 32, 34, 36 and 38 (see FIG. 2), the valve seats 50 and 52 and the ignition plug seats 54 is absorbed by thus accumulated oil, resulting in the major part of the cylinder head 10 being cooled sufficiently. On the other hands, as shown in FIG. 1, the peripheral walls 20*a*, 22*a*, 24*a*, 26*a*, 28*a* and 30*a* of the recesses 20, 22, 24, 26, 28 and 30 are formed with a plurality of oil discharging holes 60, 62, 64, 66, 68, 70, 72 and 74 through which an excessive amount of oil accumulated in the recesses 20, 22, 24, 26, 28 and 30 is discharged continuously. Among them the oil discharging holes 60, 66, 68 and 74 in the recesses 20, 24, 26, and 30 formed at both the lefthand and righthand end parts of the cylinder head 10 as well as at the position located opposite to one another relative to a cam chain chamber 90′ are communicated with stud bolt insert holes 90, 92, 94 and 96 via oil discharging passages 80, 82, 84 and 86.

Accordingly, oil in the recesses 20, 24, 26 and 30 is caused to flow into the insert holes 90, 92, 94 and 96 through the discharging holes 60, 66, 68 and 74 and the discharging passages 80, 82, 84 and 86 and thereafter it is returned to an oil pan on the engine via the insert holes 90, 92, 94 and 96. On the other hands, the discharging holes 62, 64, 70 and 72 in the recesses 22 and 28 are communicated with main discharging passages 110 and 112 formed on the exhaust ports side via discharging passages 100, 102, 104 and 106. As illustrated in FIG. 3, the main discharging passages 110 and 112 are formed at the position located between the adjacent exhaust ports on the outer surface of the cylinder head 10. The discharging passages 100, 102, 104 and 106 are formed at the position located adjacent to the wall surface of the exhaust ports in the cylinder head 10. Owing to the arrangement made in that way heat developed in the exhaust ports is absorbed by oil in the recesses 22 and 28 while it is discharged into the main discharging passages 110 and 112 via the discharging passages 100, 102, 104 and 106 whereby the exhaust ports are cooled satisfactorily.

Figure 4:
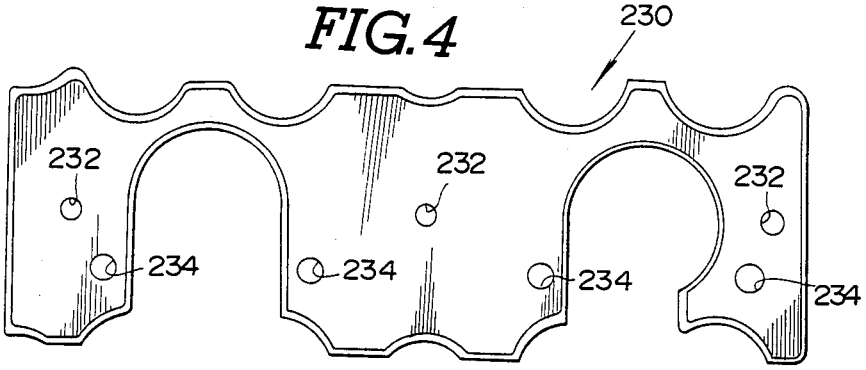
FIG. 4 is an enlarged plan view of a cover to be fitted to the cylinder head.
Figure 5:
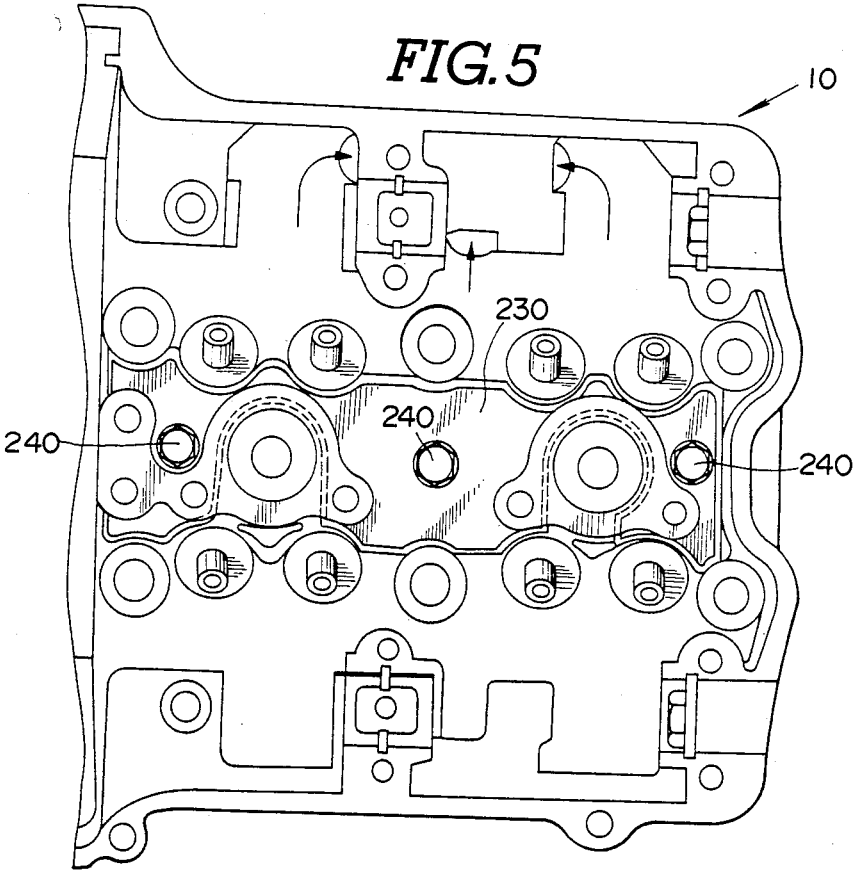
FIG. 5 is a plan view of the right half of the cylinder head with the cover fitted thereto, as seen from the above.
Figure 6:
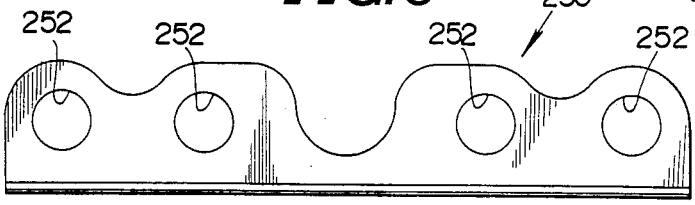
FIG. 6 is an enlarged plan view of a valve spring seat.
Figure 7:
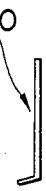
FIG. 7 is a side view of the valve spring seat in FIG. 6.
Figure 8:
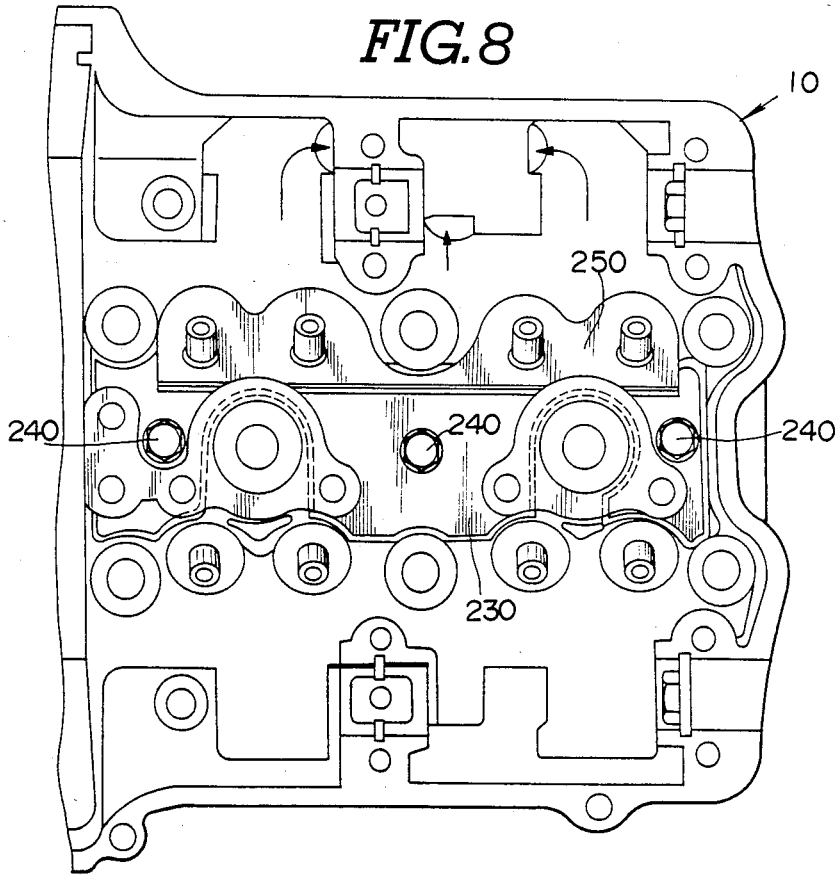
FIG. 8 is a plan view of the right half of the cylinder head with the valve spring seat attached thereto, as seen from the above.

In addition to the discharging passages 100, 102, 104 and 106 which are in communication with the recesses 22 and 28 the main discharging passages 110 and 112 are communicated with discharging passages 132, 134, 136, 138, 140 and 142 which include openings 120, 122, 124, 126, 128, and 130 on the inner surface of the cylinder head 10, causing oil flowing in the area located above the exhaust ports in the cylinder head 10 to be discharged into the main discharging passages 110 and 112 via the discharging passages 132, 134, 136, 138 and 140, as shown in FIGS. 1 and 3. Incidentally, in FIG. 1 reference numerals 150, 152, 154, 156, 158, 160, 162 and 164 designate a stud bolt insert hole respectively, through which a stud bolt (not shown) is inserted and reference numerals 170, 172, 174 and 176 do a flange portion on the top of the ignition plug mounting bosses 40, 42, 44 and 46. Each of the flange portions 170, 172, 174 and 176 is formed with a hole 180 which constitutes a part of oil feeding passage to be described later through which oil is fed into the recesses 20, 22, 24, 26, 28 and 30. Further, in FIG. 2 reference numerals 190, 192, 194 and 196 designates a hole respectively, which is formed at the position located below the exhaust ports 50′, 52′, 54′ and 65′. The holes 190, 192, 194 and 196 are communicated with the interior of the ignition plug mounting bosses 40, 42, 44 and 46 as shown in FIG. 1. Referring to FIGS. 3 and 1 again, reference numerals 210, 212, 214, 216, 218 and 220 designate a boss standing upright in the recesses 20, 22, 24, 26, 28 and 30 respectively. The bosses 210, 212, 214, 216, 218 and 220 are formed with female threads 210*a*, 212*a*, 214*a*, 216*a*, 218*a* and 220*a* (see FIG. 1). The female threads 210*a*, 212*a*, 214*a*, 216*a*, 218*a* and 220*a* are adapted to function as female portion for fastening a plate-shaped cover 230 as shown in FIG. 4 in an enlarged scale. The configuration of the cover 230 is designed to independently cover the lefthand area as defined by the group of recesses 20, 22 and 24 and the righthand area as defined by the group of recesses 26, 28 and 30, both the areas being located symmetrical relative to the cam chain chamber 90' as seen in FIG. 1. Incidentally, the cover 230 has the inverted U-shaped cross-sectional configuration in order to assure increased mechanical strength. Further, the cover 230 is formed with fitting bolt insert holes 232 and pipe fitting holes 234 through which a pipe constituting oil feeding passage to be described later is inserted. Thus, when the thus designed covers 230 are assembled on the inside of the cylinder head 10 as illustrated in FIG. 1, all the recesses 20, 22, 24, 26, 28 and 30 are covered with them, as shown in FIG. 1 which is an enlarged partial plan view of the cylinder head 10. Once the recesses 20, 22, 24, 26, 28 and 30 are covered with the covers 230 in that way, it is assured that oil held in them is inhibited from being scattered inwardly of the cylinder head 10. In FIG. 5 reference numerals 240 designate a fitting bolt respectively, by means of which the covers 230 are fastened to the cylinder head 10. Further, in order to inhibit an excessive amount of oil from being deposited on exhaust valves, valve springs or the likes, plate-shaped seats 250 are fastened to the cylinder head 10, as shown in FIG. 6 which is an enlarged plan view of the valve spring seat and FIG. 7 which is a side view of the same. As is apparent from FIG. 6, each of the valve spring seats 250 is formed with a plurality of valve guide insert holes 252 and it has the L-shaped cross-sectional configuration so as to assure increased mechanical strength. FIG. 8 is a partial plan view particularly illustrating how the valve spring seats 250 are fastened to the inside of the cylinder head 10 and same parts as those in FIGS. 1 and 5 are identified by same reference numerals. It should be noted that the valve spring seat 250 is immovably held on the valve seat by means of valve springs (not shown) in such a manner that a plurality of valve guides are simultaneously fitted through a single sheet of plate, resulting in any occurrence of undesirable turning movement of the valve spring seat as is seen with the conventional circular disc-shaped valve seat being prevented.

Next, description will be made in more details as to the oil feeding passages through which oil is fed to the recesses 20, 22, 24, 26, 28 and 30 on the cylinder head 10 as well as the method and apparatus of the invention.

Figure 9:
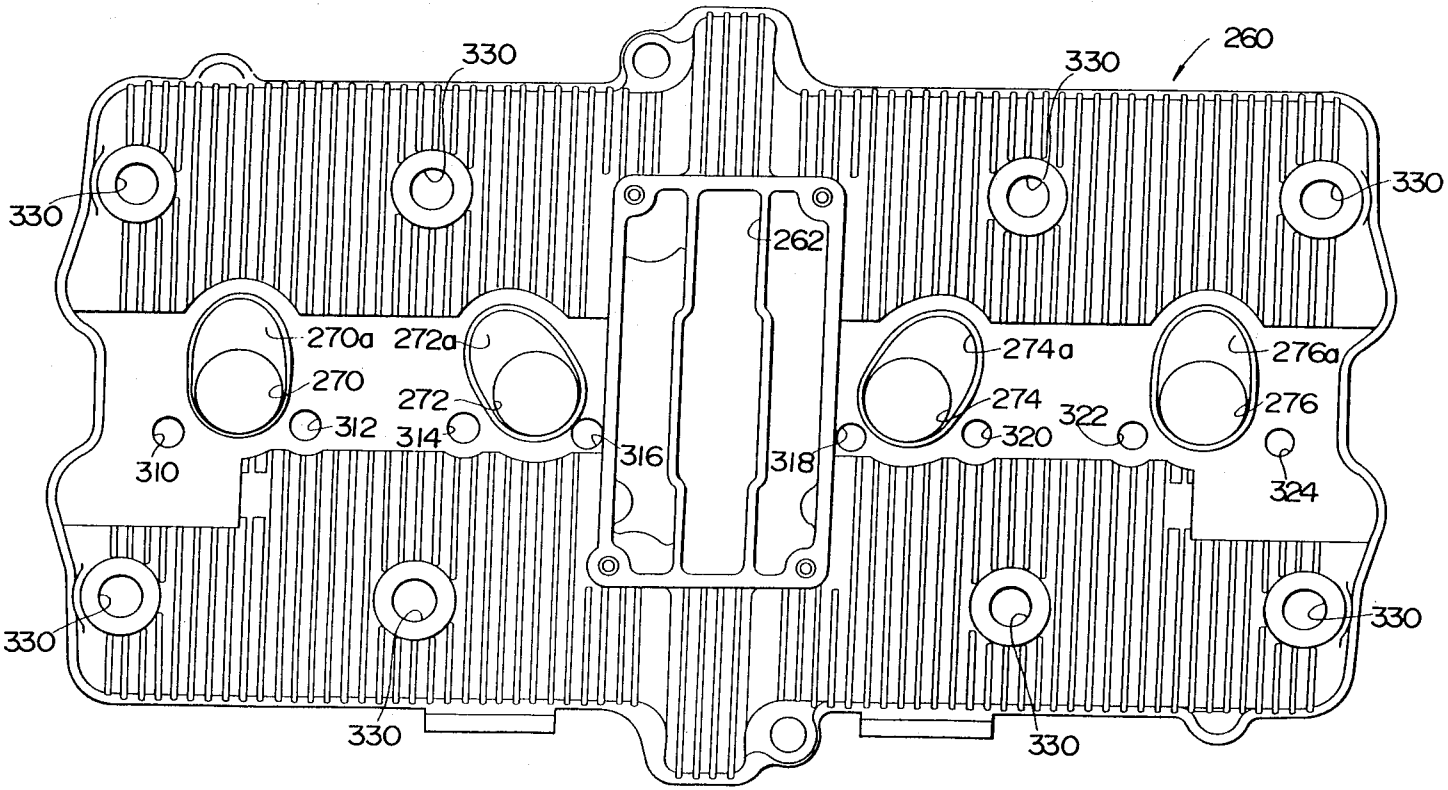
FIG. 9 is a plan view of the cylinder head cover, as seen from the above.
Figure 10:
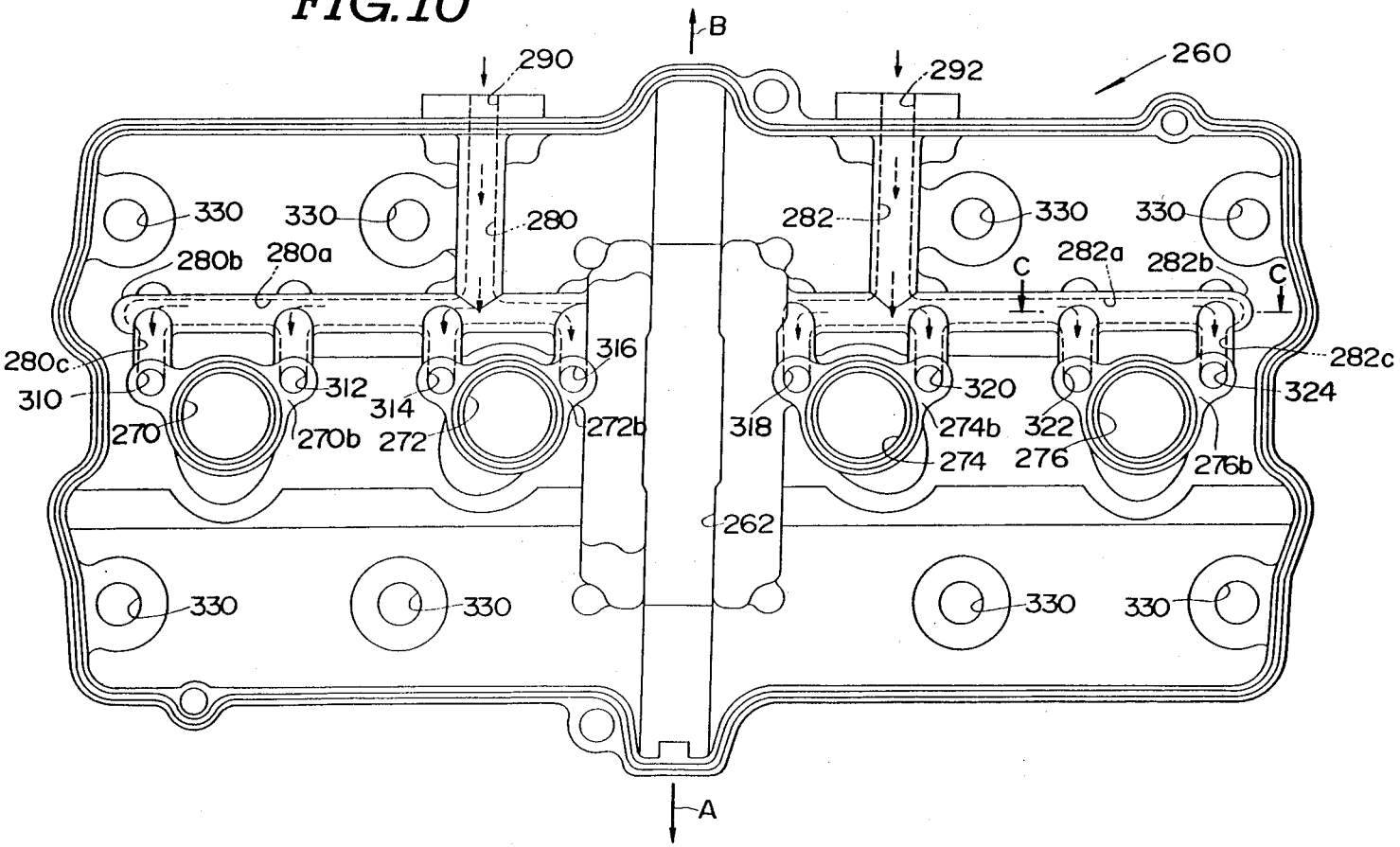
FIG. 10 is a plan view of the cylinder head cover in FIG. 9, as seen from the below.

FIGS. 9 and 10 are a plan view of a cylinder head cover 260 as seen from the above and below respectively, with which the cylinder head 10 as shown in FIG. 1 is covered.

Figure 11:
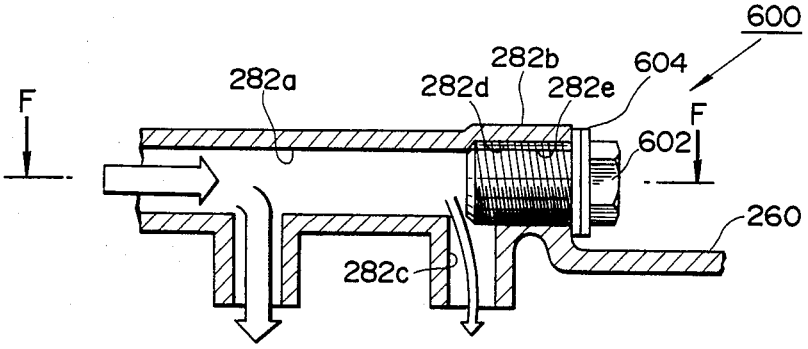
FIG. 11 is a fragmental enlarged sectional view of the cylinder head cover, taken in line C—C in FIG. 10.
Figure 12:
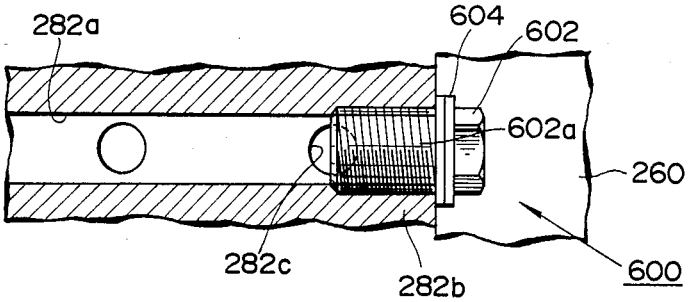
FIG. 12 is a fragmental enlarged sectional view of the cylinder head cover, taken in line F—F in FIG. 11.
Figure 13:
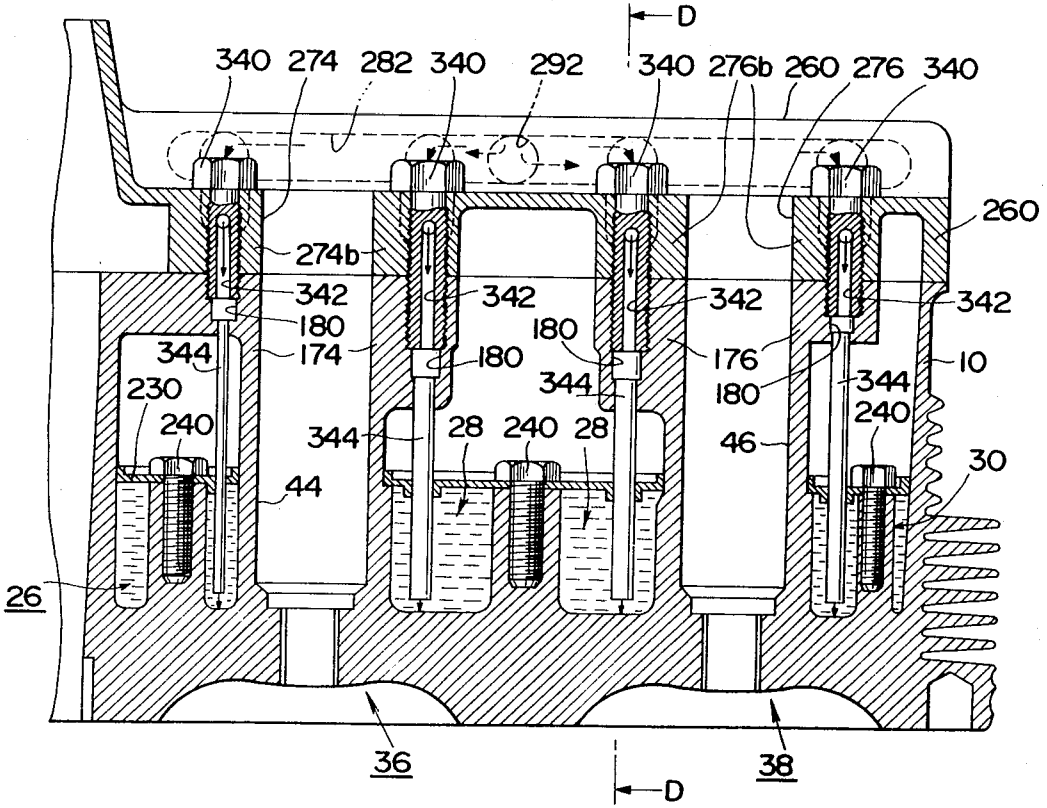
FIG. 13 is a fragmental vertical sectional view of the right half of the cylinder head with the cylinder head cover fixedly mounted thereon.
Figure 14:
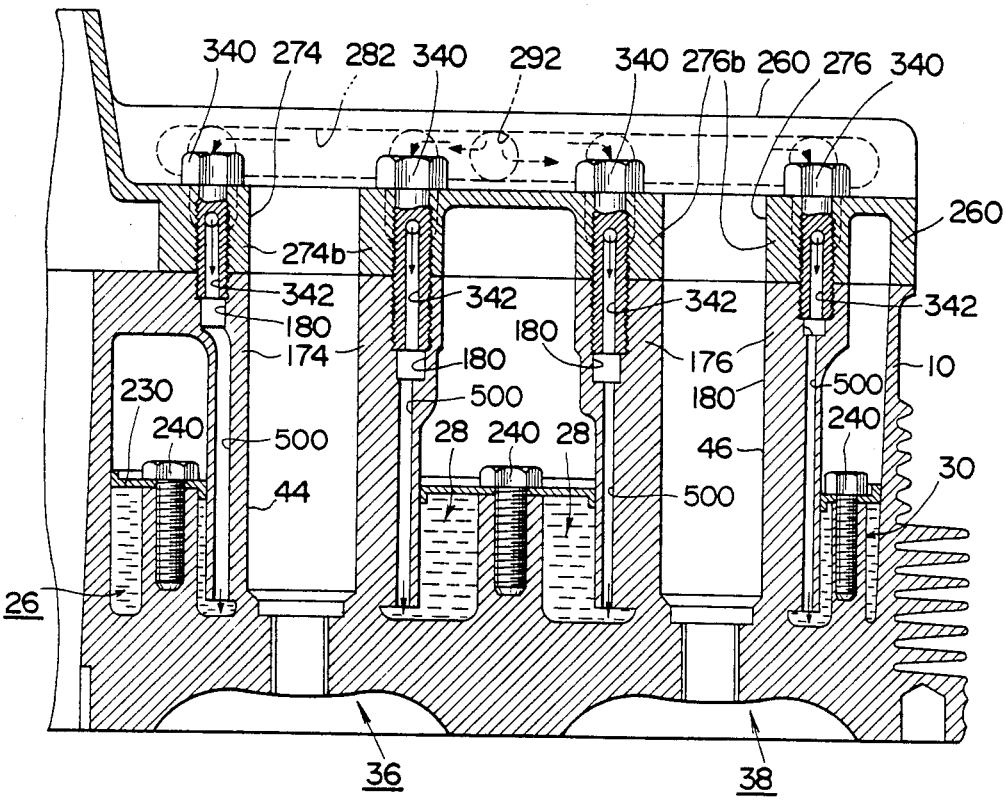
FIG. 14 is a fragmental vertical sectional view of the right half of the cylinder head with the cylinder head cover fixedly mounted thereon in accordance with another embodiment of the invention.
Figure 15:
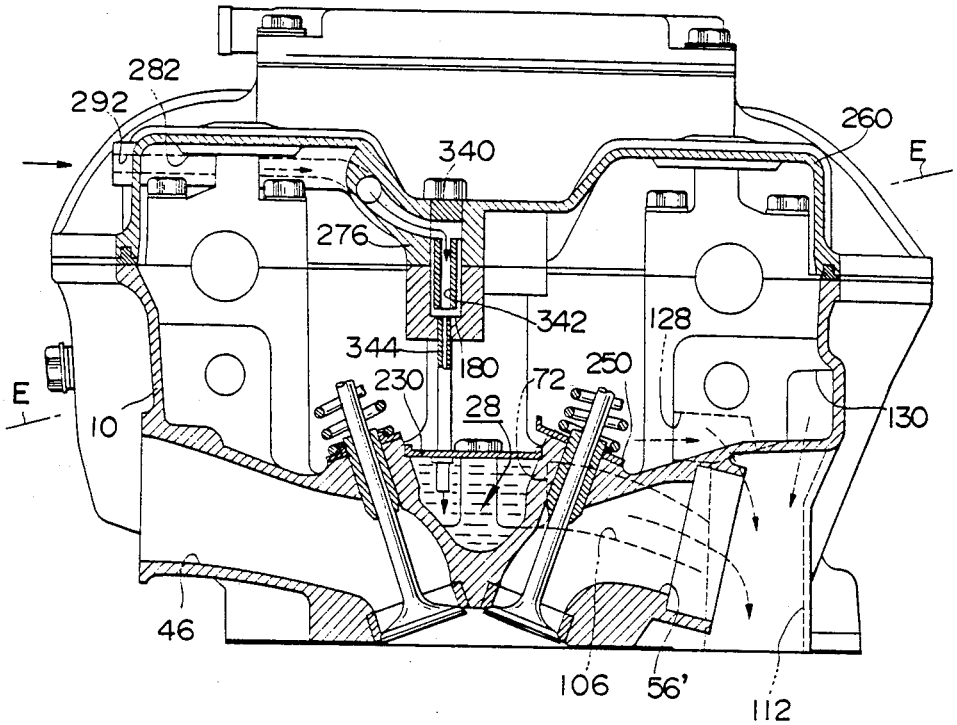
FIG. 15 is a vertical sectional view of the combination of cylinder head and cylinder head cover, taken in line D—D in FIG. 13.
Figure 16:
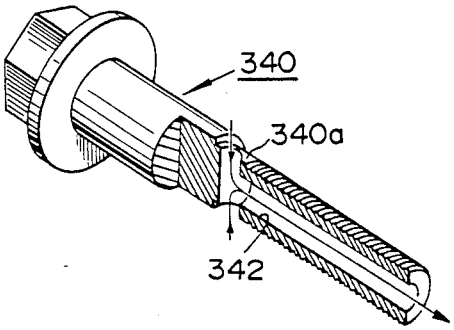
FIG. 16 is a partially sectioned perspective view of a cylinder head fastening bolt, shown in an enlarged scale.
Figure 17:
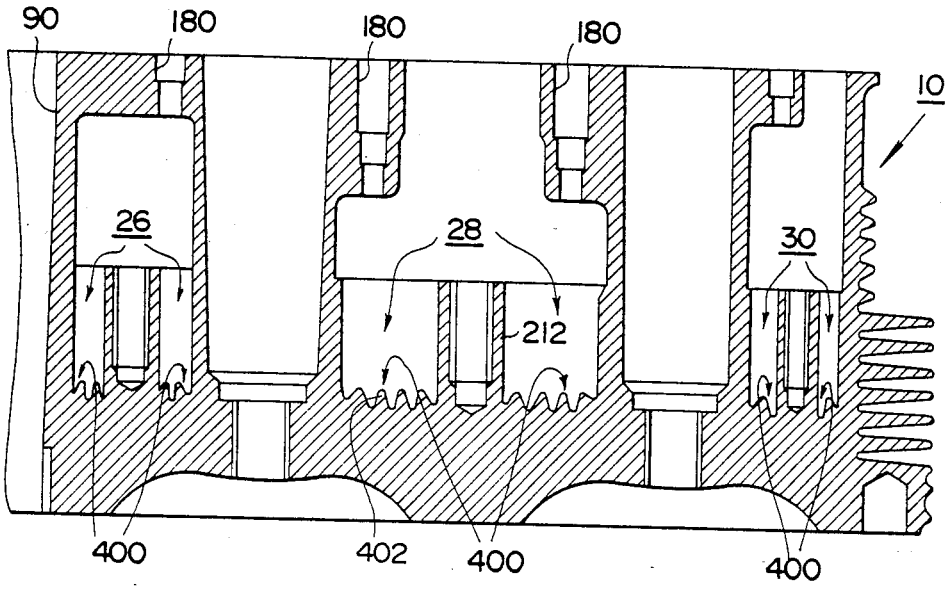
FIG. 17 is a fragmental vertical sectional view of the right half of the cylinder head, particularly illustrating how each of the recesses has a rugged bottom surface.
Figure 18:
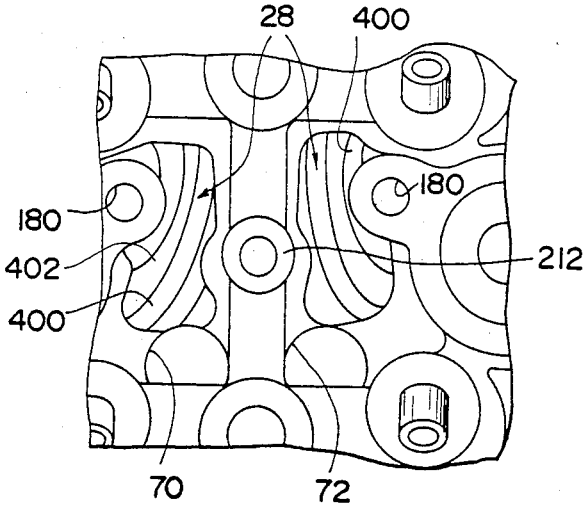
FIG. 18 is a fragmental plan view of the cylinder head in FIG. 17, particularly illustrating how a number of ridge lines on the recesses extend.

The cylinder head cover 260 is designed in the plate-shaped configuration so as to fully cover the whole surface of the cylinder head 10 and it is formed with an opening 262 at the central part thereof through which blow-by gas is taken out. Further, it is formed with a plurality of insert holes 270, 272, 274 and 276 through which ignition plugs and ignition plug fitting and removing tools are inserted, the insert holes 270, 272, 274 and 276 being arranged at the central part thereof as seen in the longitudinal direction on the drawings. Incidentally, inclined guide grooves **270*a*, 272*a*, 274*a* and 276*a* are formed on the inner wall of the insert holes 270, 272, 274 and 276. As shown in FIG. 10, oil feeding passages 280 and 282 through which oil pumped up from an oil supply device to be described later is introduced into the central part of the cylinder head cover 260 are formed on the bottom surface of the head cover 260. The one ends of the oil feeding passages 280 and 282 are communicated with feeding ports 290 and 292 on the inlet port side of the cylinder head cover 260, whereas the other ends of the same are branched to reach flange portions 270*b*, 272*b*, 274*b* and 276*b* on the insert holes 270, 272, 274 and 276. The flange portions 270*b*, 272*b*, 274*b* and 276*b* have insert holes 310, 312, 314, 316, 318, 320, 322 and 324 formed thereon through which fastening bolts (which will be described later) for immovably fastening the cylinder head cover 260 to the cylinder head (see FIG. 1) are inserted and the other ends of the branched parts of the oil feeding passages 280 and 282 are communicated with the insert holes 310, 312, 314, 316, 318, 320, 322 and 324. Owing to the arrangement made in that way, as oil is fed through the feeding ports 290 and 292 as represented by arrow marks on the drawing, it flows in the oil feeding passages 280 and 282 to reach the insert holes 310, 312, 314, 316, 318, 320, 322 and 324. It should be noted that the insert holes 310, 312, 314, 316, 318, 320, 322 and 324 are located opposite to the holes 180 on the flange portions 170, 172, 174 and 176 of the bosses 40, 42, 44 and 46. Incidentally, in FIGS. 9 and 10 reference numerals 330 designate an insert hole respectively, through which a fastening bolt is inserted to immovably fasten the cylinder head cover 260 to the cylinder head 10 (see FIG. 1). As illustrated in FIG. 11 which is an fragmental enlarged sectional view of the branched part of the oil passages taken in line C—C in FIG. 10, the oil passages 280 and 282 include main passages 280*a* and 282*a* extending in the longitudinal direction of the cylinder head cover 260 of which outer end parts 280*b* and 282*b* are equipped with a flow rate regulating device 600 respectively in order to regulate a flow rate of oil to be introduced into the branched passages 280*c* and 282*c*. For the purpose of simplification description will be made below only as to the flow rate regulating device 600 disposed in the main passage 282*a*. As will be apparent from the drawing, the flow rate regulating device 600 essentially comprises an opening 282*e* with female threads 282*d* formed on the inner wall at the right end part 282*b* of the main passage 282*a* and a plug 602 in the form of bolt adapted to be threadably engaged to the female threads 282*d*. When the flow rate adjusting device 600 as constructed in the above-described manner is employed for the cylinder head cover 600, a cross-sectional area of the branched passages 282*c* can be varied in dependence on the position of the end face of the plug 602 which is determined by the thickness of a gasket 604 disposed between the flange portion of the plug 602 and the end face of the right end part 282*b* of the main passage 282*a*, as illustrated in FIG. 12 which is a fragmental enlarged sectional view of the right branched part of the oil passage taken in line F—F in FIG. 11. Thus, a flow rate of oil to be introduced into the insert hole 324 as shown in FIG. 10 can be adjusted as required. Further, a flow rate of oil to be introduced into the insert hole 310 as shown in FIG. 10 can be adjusted in the same manner as described above. As a flow rate of oil to be introduced into the insert holes 310 and 324 is varied by means of the flow rate adjusting devices 600, the recesses 20 and 30 having a comparatively small hollow space among the recesses 20, 22, 24, 26, 28 and 30 (see FIG. 1) are supplied with a properly determined volume of oil. On the other hands, after oil reaches the insert holes 310, 312, 314, 316, 318, 320, 322** and 324 on the cylinder head cover 260, it flows through oil passages 342 formed in the fastening bolts 340 and oil introducing means constituted by a combination of holes 180 and pipes 344 fitted into the holes 180 on the flange portions 170, 172, 174 and 176 as shown in FIG. 13 which is an enlarged fragmental sectional view of the cylinder head cover 260 fastened to the cylinder head 10 and FIG. 15 which is a cross-sectional view of the cylinder head 10 and the cylinder head cover 260 taken in line D—D in FIG. 11. Thereafter, it is delivered into each of the recesses 20, 22, 24, 26, 28 and 30 on the cylinder head 10. As mentioned above, in the embodiment as illustrated in FIG. 13 oil is introduced into the recesses 20, 22, 24, 26, 28 and 30 via the holes 180 on the flange portions 170, 172, 174 and 176 and the pipes 344 but the present invention should not be limited only to this. Alternatively, arrangement may be made such that the flange portions 170, 172, 174 and 176 are extended until they reach the recesses 20, 22, 24, 26, 28 and 30 and an oil passage 500 is drilled through each of the flange portions 170, 172, 174 and 176 without any use of pipes such as the pipes 344 whereby oil introducing means is constitured by the oil passage 500 in each of the flanges, as illustrated in FIG. 14 which illustrates another embodiment of the invention. Incidentally, same parts and components as those in FIG. 13 are identified by same reference numerals. In the case of a fastening bolt 340 as illustrated in FIG. 16 by way of enlarged sectional perspective view it is formed with a T-shaped oil passage 342 so that oil is introduced toward the lowermost end through the oil passage 342 after entrance from the peripheral surface 340*a* of the bolt 340 as represented by arrow marks. Incidentally, parts in FIGS. 13 to 16 as those in FIGS. 1, 3, 5, 8 and 11 are identified by same reference numerals. After oil is supplied by injection into each of the recesses 20, 22, 24, 26, 28 and 30 on the cylinder head 10, it is discharged into the insert holes 90, 92, 94 and 96 or the main discharging passages 110 and 112 via the discharging holes 60, 62, 64, 66, 68, 70, 72 and 74 (see FIG. 1) on the peripheral walls 20*a*, 22*a*, 24*a*, 26*a*, 28*a* and 30*a* of the recesses 20, 22, 24, 26, 28 and 30.

It should be noted that an engine mounted on motorcycle is usually mounted thereon in the forwardly inclined posture as seen in the direction of running due to a requirement for reducing the height of the body as far as possible. For the reason the cylinder head 10 is held in such an inclined state that the exhaust port side is lowered as represented by a horizontal line E—E in FIG. 15 whereby oil discharged into the cylinder block after slidable components such as cam shafts or the like are lubricated properly is caused to flow into the discharging holes 120, 122, 124, 126, 128 and 130 as shown in FIG. 1 in the same manner as oil temporarily accumulated in the recesses and thereafter it is discharged into the main discharging passages 110 and 112 via the discharging holes.

In the above-described embodiment each of the recesses 20, 22, 24, 26, 28 and 30 has a flat bottom surface 400 which extends substantially in parallel with the upper surface of the associated combustion chamber, as shown in FIG. 3. However, the present invention should not be limited only to this. Alternatively, each of the recesses 20, 22, 24, 26, 28 and 30 may be formed with a plurality of heat radiating fins 402 on the bottom surface 400 thereof in order to increase contact area over which oil temporarily accumulated in the recess comes in surface contact with the associated heat radiating fins 402 on the bottom surface 400 and thereby assure increased cooling effect in the presence of oil, as shown in FIG. 14 which is a fragmental enlarged vertical sectional view. Also in this embodiment same parts as those in FIG. 3 are identified by same reference numerals. In addition to this a number of ridge lines on the heat radiating fins may have specific directional configuration, ask shown in FIG. 16 which is a fragmental plan view of FIG. 15. This embodiment is intended to allow oil to smoothly flow toward the discharging holes.

Figure 19:
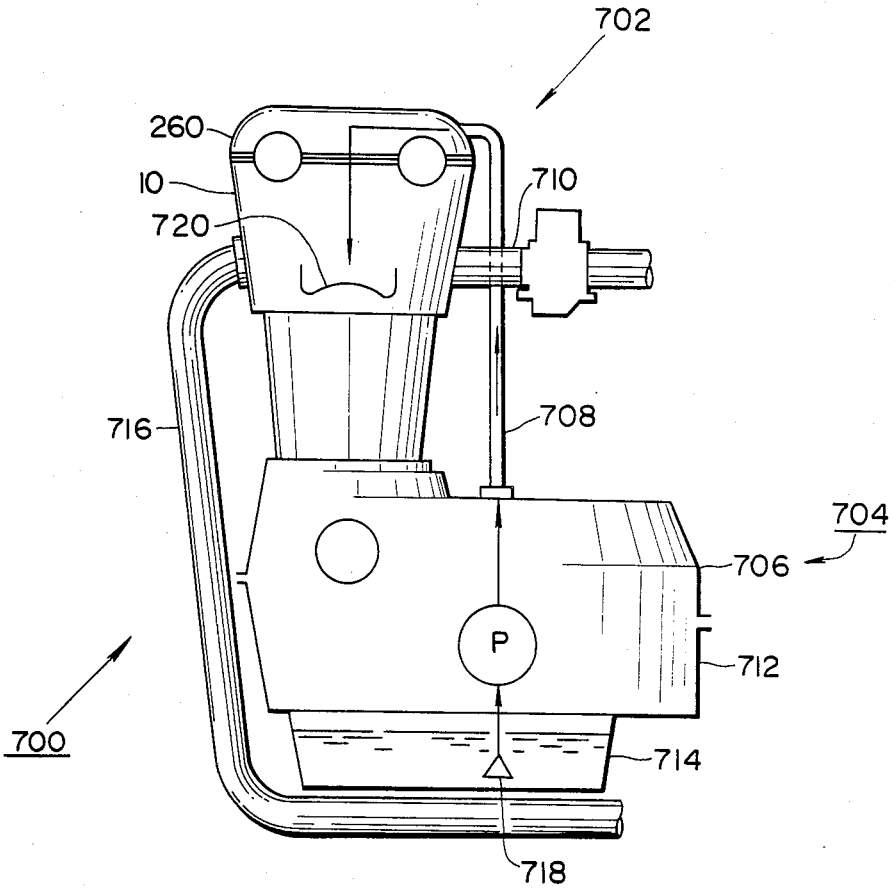
FIG. 19 is a schematic view of the engine, particularly illustrating how an oil supplying device is constructed.

Finally, FIG. 19 is a schematic view of the engine 702, particularly illustrating an oil supplying device 700 which serves to pump up oil to the feeding ports 290 and 292 on the cylinder head cover as shown in FIG. 10. Same parts and components as those in FIGS. 1 and 10 are identified by same reference numerals.

Specifically, the oil supplying device 700 essentially comprises a pipe 708 by way of which hydraulic communication communication is established between the feeding ports 290 and 292 on the cylinder head cover 260 and the upper case 706 of a crankcase 704 and an oil pump P for pumping up oil through the pipe 708.

Incidentally, the pipe 708 is extended in the area located in the proximity of an intake tube 710 of the engine 702 and a lower case 712 of the crankcase 704, 704 has the oil pan 14 attached to the bottom part thereof in which lubricating oil is received. In FIG. 19 reference numeral 716 designates an exhaust tube, reference numeral 718 does a strainer and reference numeral 720 generally does a plurality of recesses 20, 22, 24, 26, 28 and 30.

As the oil supplying device 700 as constructed in the above-described manner is operated, lubricating oil received in the oil pan 714 is sucked into the oil pump P through the strainer 718 and pressurized oil is pumped up from the oil pump P to the feeding ports 290 and 292 (see FIG. 10) via the pipe 708. In the illustrated embodiment the pipe 708 is located at the position behind the engine 702. Thus, there is no fear of causing transmission of heat from the exhaust tube to oil flowing through the pipe 708, resulting in oil in the tube 708 being inhibited from deterioration under the influence of thus transmitted heat.

In the above-described embodiment oil pumped up from the oil supplying device 700 is delivered to the holes 180 (see FIGS. 13 and 14) on the flange portions 170, 172, 174 and 176 of the ignition plug fitting bosses 40, 42, 44 and 46 via the oil passages 280 and 282 (see FIG. 10) on the cylinder head cover 260. However, it should be understood that the present invention should not be limited only to this. Alternatively, oil may be delivered from the oil supplying pump 700 directly to the holes 180 on the flange portions 170, 172, 174 and 176.

As will be obvious for any expert in the art, various changes or modifications may be made for the invention in any acceptable manner without departure from the spirit and scope of the invention. Accordingly, it should be considered that the above-described embodiments are merely illustrative and therefore they should not be interpreted limitatively. After all, the scope of the invention is as defined by the claim clause without any restriction or limitation being effected by the description of the specification. Finally, it should be understood that all changes or modifications falling under scope of the claim clause should be construed within the scope of the invention.

What is claimed is:

1. An apparatus for cooling the cylinder head of an engine, wherein oil introducing means for introducing oil to the area located above the combustion chambers in the cylinder head is arranged at the position located in the vicinity of each of ignition plug fitting bosses in the cylinder head, oil feeding passages by way of which oil is delivered to said oil introducing means are formed on the cylinder head cover fixedly mounted on the cylinder head, each of the oil supplying passages includes a main passage extending in the longitudinal direction of the cylinder head and a flow rate adjusting device for adjusting a flow rate of oil flowing through a branched passaged branched from said main passage is disposed at the extreme end of the main passage.

2. An apparatus as defined in claim 1, wherein said flow rate adjusting device essentially comprises an opening at the extreme end of the main passage with female threads formed on the inner wall thereof and a plug threadably engaged to said opening, said plug serving to vary the cross-sectional area of the branched passage.

3. An apparatus as defined in claim 2, wherein the plug comprises a bolt.

4. An apparatus as defined in claim 1, wherein each of the ignition plug fitting bosses includes a flange portion on which the oil introducing means is disposed.

5. An apparatus as defined in claim 1, wherein each of the ignition plug fitting bosses includes a flange portion on which the oil introducing means is disposed, the oil introducing means essentially comprises a hole drilled in the flange portion and a pipe of which both ends are opened, the one end of said pipe being fitted into said hole and the other end of the same being exposed to the area located above the combustion chamber in the cylinder head.

6. An apparatus as defined in claim 1, wherein each of the ignition plug fitting bosses includes a flange portion on which the oil introducing means is disposed, the oil introducing means comprises an oil passage drilled in the flange portion, the lower end of said oil passage being exposed to the area located above the combustion in the cylinder head.

7. A method for cooling a cylinder head of an engine comprising the steps of:

disposing a nozzle such that a jetting outlet of the nozzle is positioned close to and confronting an area located in the vicinity of a plug seat in said cylinder head;

spouting oil used for lubricating the engine by way of said nozzle to the area around said plug seat in said cylinder head without passing through a valve actuating mechanism; and accumulating said spouted oil temporarily in an area located in the vicinity of said plug seat in said cylinder head.

8. An apparatus for cooling cylinder head of an engine comprising:

a cylinder head cover for covering said cylinder head;

an oil feeding passage formed in said cylinder head cover, said oil feeding passages including a main passage extending along the longitudinal direction of said cylinder head, branched passages branched from said main passage, and a flow rate adjusting device disposed at the extreme end of the main passage for adjusting a flow rate of oil flowing through said branched passages; and oil introducing means arranged at a position located in the vicinity of each of ignition plug fitting bosses in said cylinder head for introducing oil supplied from said oil feeding passage to areas located above combustion chambers in the cylinder head.

9. An apparatus as defined in claim 8, wherein said flow rate adjusting device comprises an opening at the extreme end of the main passage with female threads formed on the inner wall thereof and a plug threadably engaged to said opening, said plug serving to vary the cross-sectional area of the branched passages.

10. An apparatus as defined in claim 9, wherein said plug comprises a bolt.

11. An apparatus for cooling a cylinder head of an engine comprising:

a cylinder head cover for covering said cylinder head;

an oil feeding passage formed in said cylinder head cover;

a flange portion mounted on ignition plug fitting bosses; and oil introducing means arranged at a position located in the vicinity of each of said ignition plug fitting bosses in said cylinder head for introducing oil supplied from said oil feeding passage to areas located above combustion chambers in said cylinder head, said oil introducing means including holes provided in said flange portion and pipes whose opposing ends are opened, the one end of said pipes being fitted into said holes and the other end of the same extending to areas located above said combustion chambers in said cylinder head.

12. An apparatus for cooling a cylinder head of an engine comprising:

a cylinder head cover for covering said cylinder head;

an oil feeding passage formed in said cylinder head cover;

a flange portion mounted on ignition plug fitting bosses; and oil introducing means arranged at a position located in the vicinity of each of ignition plug fitting bosses in said cylinder head for introducing oil supplied from said oil feeding passage to an area located above the combustion chambers in said cylinder head and upon exterior surfaces of said bosses, said oil introducing means being holes provided in said flange portion, the lower end of said oil passage extending to areas located above combustion chambers in the cylinder head.

13. An apparatus for cooling a cylinder head of an engine comprising:

a recess formed around a plug seat in said cylinder head;

a flange portion mounted on ignition plug fitting bosses of said plug seat;

a nozzle mounted on said flange portion, the one end thereof extending into said recess and the other end extending to the inner wall of a cylinder head cover;

an oil passage formed in said cylinder head cover, the one end thereof being connected with the other end of said nozzle and the other end of said passage is opened at the side wall of cylinder head cover;

a pipe extending between a crankcase and said cylinder head cover, the one end of said pipe being connected with the opening of said oil passage at the side wall of said cylinder head cover and the other end of the same extending into said crankcase;

an oil pan provided in said crankcase; and an oil pump disposed in said crankcase for pumping up oil accumulated in said oil pan to the other end of said pipe.

14. An apparatus as defined in claim 13 wherein said recess includes a discharging hole through which accumulated oil is discharged.

15. An apparatus as defined in claim 14 wherein said recess is formed with a plurality of heat radiating fins on the bottom surface thereof, said fins being oriented toward the discharging hole.

* * * * *